US008695581B2

(12) United States Patent
Felt et al.

(10) Patent No.: US 8,695,581 B2
(45) Date of Patent: Apr. 15, 2014

(54) ARCHERY BOW STABILIZER APPARATUS

(75) Inventors: James T. Felt, Kaysville, UT (US); Douglas E. Denton, Stansbury Park, UT (US)

(73) Assignee: Jas D. Easton, Inc., Salt Lake City, UT (US)

( * ) Notice: Subject to any disclaimer, the term of this patent is extended or adjusted under 35 U.S.C. 154(b) by 248 days.

(21) Appl. No.: 13/089,089

(22) Filed: Apr. 18, 2011

(65) Prior Publication Data

US 2012/0260902 A1 Oct. 18, 2012

(51) Int. Cl.
*F41B 5/20* (2006.01)

(52) U.S. Cl.
USPC ..... 124/89

(58) Field of Classification Search
USPC ..... 124/89; 188/378, 379; 267/136, 137
See application file for complete search history.

(56) References Cited

U.S. PATENT DOCUMENTS

| | | | | |
|---|---|---|---|---|
| 3,690,414 | A | 9/1972 | Aggarwal et al. | |
| 4,235,059 | A | 11/1980 | Wemyss | |
| 4,570,608 | A | 2/1986 | Masterfield | |
| 4,615,327 | A | 10/1986 | Saunders | |
| 4,893,606 | A | 1/1990 | Sisko | |
| 5,016,602 | A | 5/1991 | Mizek | |
| 5,109,645 | A | 5/1992 | Bucci | |
| 5,117,580 | A | 6/1992 | Brown | |
| 5,370,104 | A | 12/1994 | Neie | |
| 5,482,294 | A | 1/1996 | Sullivan et al. | |
| 5,487,375 | A | 1/1996 | McDonald | |
| 5,511,533 | A | 4/1996 | Walker | |
| 5,671,504 | A | 9/1997 | Gou | |
| 5,735,257 | A | 4/1998 | Walk | |
| 5,860,538 | A | 1/1999 | Duero et al. | |
| 5,975,070 | A | 11/1999 | Sands | |
| 6,186,135 | B1 | 2/2001 | Harwath et al. | |
| 6,216,413 | B1 | 4/2001 | Lapointe | |
| 6,428,433 | B1 | 8/2002 | Liechty, II | |
| 6,540,628 | B1 | 4/2003 | Musacchia, Jr. | |
| 6,675,793 | B1 * | 1/2004 | Saunders | 124/89 |
| 6,684,874 | B2 * | 2/2004 | Mizek et al. | 124/89 |
| 6,718,964 | B1 | 4/2004 | Graf | |
| 6,997,174 | B2 | 2/2006 | Sandberg | |
| 7,410,187 | B2 | 8/2008 | Hartenstine et al. | |
| D576,722 | S | 9/2008 | Nishio et al. | |
| 7,600,299 | B2 | 10/2009 | Hendrickson | |
| 7,644,743 | B2 | 1/2010 | Fenton et al. | |
| 7,793,645 | B2 | 9/2010 | Walk et al. | |
| D637,749 | S | 5/2011 | Bayat et al. | |
| 8,025,455 | B2 | 9/2011 | Huang et al. | |
| 2001/0025636 | A1 | 10/2001 | Harwath et al. | |
| 2002/0104526 | A1 | 8/2002 | Chipman | |

(Continued)

OTHER PUBLICATIONS

Tasa Newsletter dated Winter 2005 and photographs of Tasa stabilizer (6 pages).

(Continued)

*Primary Examiner* — John Ricci
(74) *Attorney, Agent, or Firm* — Holland & Hart

(57) ABSTRACT

An archery bow stabilizer includes a proximal end, a distal end, and an elliptical shaped cross-section. The elliptical shaped cross-section is arranged perpendicular to a length dimension of the stabilizer at a location between the proximal and distal ends. The elliptical shaped cross-section has a ratio of a maximum height dimension to a maximum width dimension that is about 0.6 or less.

33 Claims, 16 Drawing Sheets

(56) References Cited

U.S. PATENT DOCUMENTS

| | | | |
|---|---|---|---|
| 2003/0009853 | A1 | 1/2003 | Kuo |
| 2006/0113046 | A1 | 6/2006 | Prince et al. |
| 2006/0283435 | A1 | 12/2006 | Pellerite |
| 2007/0151553 | A1 | 7/2007 | Leven |
| 2008/0023594 | A1 | 1/2008 | Weder |
| 2009/0107788 | A1 | 4/2009 | Lin |
| 2010/0078454 | A1 | 4/2010 | Sauter et al. |
| 2010/0095480 | A1 | 4/2010 | Scicluna |
| 2011/0139841 | A1 | 6/2011 | Sautter et al. |
| 2011/0239401 | A1 | 10/2011 | Scicluna |
| 2012/0012723 | A1 | 1/2012 | Mansfield |
| 2012/0240913 | A1* | 9/2012 | Stokes ..... 124/89 |

OTHER PUBLICATIONS

Innerloc Internet articles on blade alignment technology (6 pages), www.innerloc.com; date unknown, printed Dec. 21, 2010.

* cited by examiner

ARCHERY BOW STABILIZER APPARATUS

TECHNICAL FIELD

The present disclosure is directed to archery bows and accessories for archery bows, and more particularly to stabilizing devices used with archery bows.

BACKGROUND

When an arrow is shot from an archery bow, the bow moves in response to the forces generated upon release of the bowstring. In addition, the bow absorbs the energy not imparted to the arrow, which causes the bow to vibrate. Movement and vibration of the bow has a direct impact on shooting accuracy. A bow stabilizer device may be attached to the bow to balance the bow and dampen vibrations in the bow to minimize unintentional bow movement when shooting. One function of a bow stabilizer is to provide a counterweight that helps stabilize and maintain the bow in an upright position during launching of the arrow.

One conventional type of bow stabilizer is a rod with a circular cross-section. Rod stabilizers may use a rod alone or use a system of movable weights along the rod length. Some rod stabilizers include a plurality of rods arranged radially spaced apart from each other. Rod stabilizers that include only a rod may act as both a spring and a weight, wherein the spring portion transfers the energy of the bow to another "weight" portion of the rod. In a system that includes a rod and separate weights, the rods act as a spring to transfer the energy of the bow to the weights.

Stabilizers are typically constructed to extend in a forward direction from the bow when the bow is oriented in an upright, shooting position. Stabilizers are usually mounted to the bow in an orientation that positions the stabilizer extending beyond the body and arms of the shooter. In certain conditions, such as crosswinds, the stabilizer may act as a wind vane that actually destabilizes the bow prior to shooting the arrow.

These and other problems are avoided and numerous advantages are provided by the apparatus described herein.

SUMMARY

One aspect of the present disclosure is directed to an archery bow stabilizer that includes a stabilizer member and an attachment member. The stabilizer member has an elliptical-shaped cross-section having a ratio of a minor axis dimension to a major axis dimension of about 0.6 or less to minimize a profile of the stabilizer exposed to crosswind forces. The attachment member is configured to connect the stabilizer member to an archery bow.

The stabilizer member may include an elongate body and at least one damping member connected to an outer surface of the elongate body. The at least one dampening member may include an elongate body arranged parallel with a length dimension of the stabilizer. The at least one dampening member may be connected to and extend from a distal end of the elongate body. The at least one dampening member may include a plurality of dampening members arranged around a periphery of the elongate body. The plurality of dampening members may be unequally spaced apart around a periphery of the elongate body.

A size of the elliptical cross-section may change along a length dimension of the stabilizer. The attachment member may include a threaded attachment portion extending from a proximal end of the archery bow stabilizer, wherein the threaded attachment portion is operable to selectively adjust a final rotated position of the archery bow stabilizer relative to an archery bow. The threaded attachment portion may include a threaded portion configured to threadably connect to the archery bow stabilizer, and a second threaded portion configured to threadably connect to the archery bow. The first threaded portion may be more difficult to rotate relative to the archery bow stabilizer than rotation of the second portion relative to the archery bow. The ratio of the minor axis dimension to the major axis dimension may be in the range of about 0.4 to about 0.45.

Another aspect of the present disclosure relates to an archery bow that includes a riser, limbs extending from the riser, at least one cable member extending between the limbs, a stabilizer, and a stabilizer connector. The stabilizer may extend from the riser and include a non-circular cross-sectional shape. The stabilizer connector is operable to adjust a final rotated position of the stabilizer to align a minor axis dimension of the non-circular cross-sectional shape with a length dimension of the riser.

The non-circular cross-sectional shape may have a ratio of a maximum height dimension to a maximum width dimension that is in the range of about 0.1 to about 0.6. The non-circular cross-sectional shape may have a ratio of a maximum height dimension to a maximum width dimension that is in the range of about 0.35 to about 0.5. The stabilizer connecter may include a first threaded portion configured to threadably connect to the stabilizer, and a second threaded portion configured to threadably connect to the riser. A stabilizer connecter may provide a connection with the stabilizer that has a greater friction than a connection with the riser. The stabilizer connecter may include a first threaded portion configured to threadably connect to the stabilizer, and a second threaded portion configured to threadably connect to the riser, and the stabilizer includes a set screw configured to releasably secure the first threaded portion in a rotated position relative to the stabilizer.

The archery bow may further include at least one dampener mounted to the stabilizer. The at least one dampener may include a plurality of dampeners mounted around a perimeter of the stabilizer. At least some of the plurality of dampeners may be elongate-shaped and arranged in parallel with the length dimension of the stabilizer. At least a portion of the stabilizer may include a plurality of dimples positioned on an exterior surface thereof. The dimples may define a dimpled surface on at least a portion of the stabilizer.

Another aspect of the present disclosure relates to a method of mounting a stabilizer to an archery bow. The method may include providing an archery bow, a stabilizer, and a stabilizer connecter threadably connected to the stabilizer. The stabilizer may have a cross-sectional shape with a greater width dimension than a height dimension. The stabilizer may be operable to stabilize the archery bow during use. The method may further include threadably mounting the stabilizer to the archery bow with the stabilizer connecter by rotating the stabilizer into a stop position wherein no further rotation is possible. The method may also include checking whether the height dimension of the stabilizer is aligned with a length dimension of the archery bow when the stabilizer is in the stop position. If the stop dimension of the stabilizer is not aligned with a length dimension of the archery bow when in the stop position, the method may further include threadably dismounting the stabilizer from the archery bow, rotating the stabilizer connecter relative to the stabilizer, and threadably mounting the stabilizer to the archery bow with the stabilizer connecter by rotating the stabilizer into the stop position. The method may include repeating the checking step, threadably dismounting step, rotating the stabilizer connecter step, and threadably mounting the stabilizer step until the height dimension of the stabilizer is aligned with the length dimension of the archery bow.

The stabilizer connecter may include a first threaded portion configured to threadably connect with the stabilizer, and a second threaded portion configured to threadably connect with the archery bow, wherein the first and second threaded portions have different friction properties. The stabilizer connecter may include a tool interface at a proximal end thereof, and rotating the stabilizer may include coupling a tool to the tool interface and applying a rotation force to the stabilizer connector with the tool. The stabilizer may have a ratio of height dimension to width dimension in the range of about 0.1 to about 0.5. The method may further include positioning a dampener on the stabilizer. The method may also include releasably fixing the stabilizer connecter in a rotated position relative to the stabilizer.

The foregoing and other features, utilities, and advantages of the subject matter described herein will be apparent from the following more particular description of certain embodiments as illustrated in the accompanying drawings.

DETAILED DESCRIPTION

Figure 1:
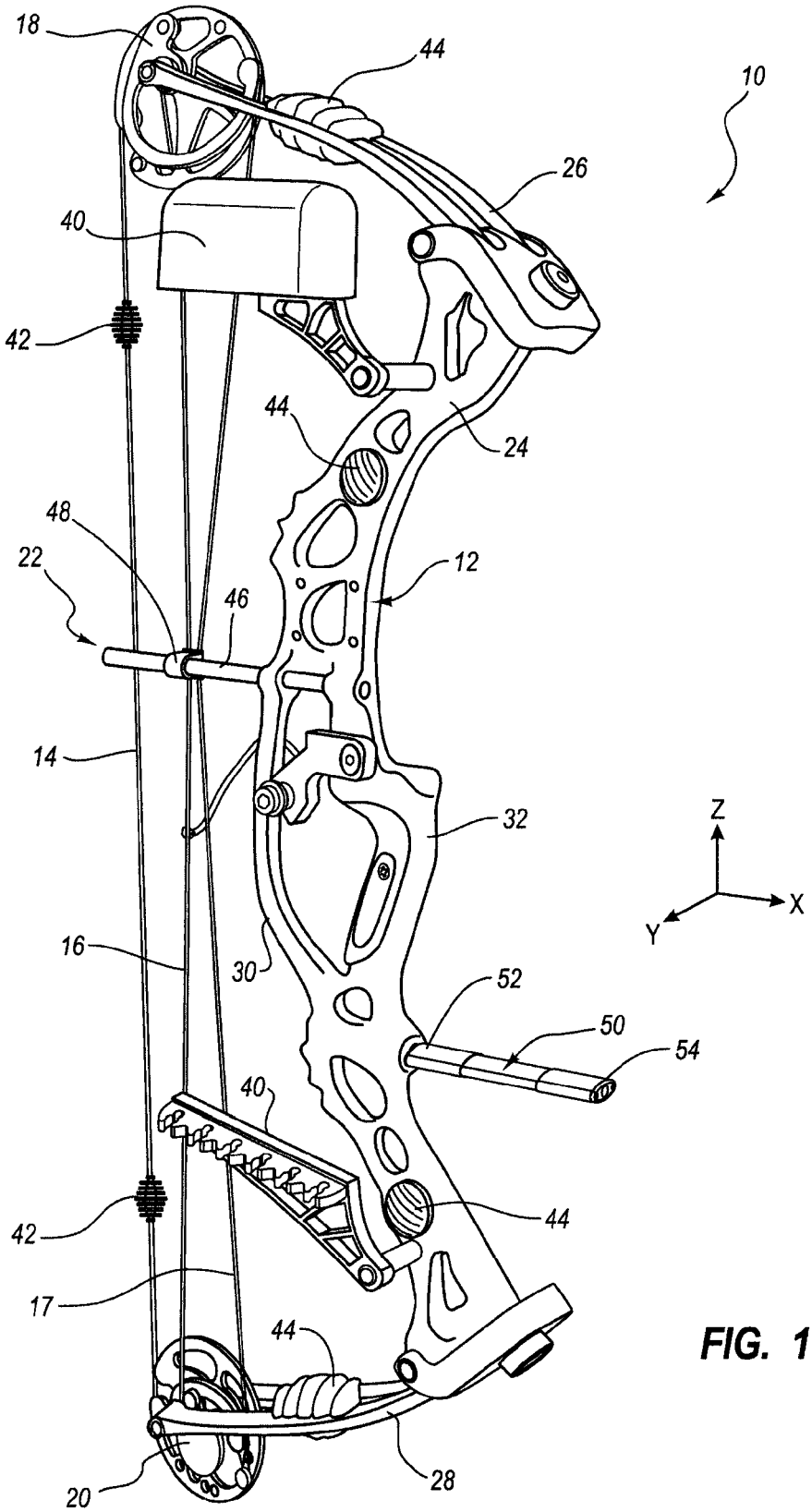
FIG. 1 is a perspective view of a bow having an example stabilizer in accordance with the present disclosure.

The present disclosure is directed to archery bow stabilizers. Archery bow stabilizers ("stabilizers") are typically mounted to a handle riser assembly of the archery bow. The stabilizer usually is arranged extending in a forward direction when the archery bow is in the upright position and oriented for shooting an arrow in a forward direction. The stabilizer may be oriented extending from a riser portion of an archery bow in the same direction as the arrow travels from the archery bow.

The stabilizer may provide several different functions. For example, the stabilizer may provide a stabilizing function that helps counterbalance the weight of the bow relative to the user's hand that supports the bow. In some examples, the stabilizer may help maintain the bow in the upright position during and after release of the bowstring to shoot the arrow. The stabilizer may also provide vibration dampening functions. Some stabilizer constructions include dampening features that dampen shock and vibration in the bow that result from shooting an arrow.

Archery bow stabilizers are typically constructed as an elongate member. The stabilizer, as mentioned above, extends in the generally forward direction when the archery bow is in the upright position. Orientation of the stabilizer is usually forward of the user and extends forward of the handle assembly of the archery bow. This orientation of the stabilizer may make it more or less susceptible to influence by environmental conditions, such as crosswinds, headwinds and driving rain.

The presence of crosswinds when shooting an archery bow, particularly in competition bow shooting and hunting situations, is likely to impact shooting accuracy. The stabilizer may function as a lever, which when contacted by crosswinds creates a moment arm and rotates the archery bow about a vertical axis. Gusting crosswinds tend to create rotation in the archery bow that is difficult for the user to counteract.

The example stabilizers of the present disclosure are constructed with a relatively low profile in a lateral direction to help limit the influence of crosswinds and other environmental conditions when using the archery bow. The example stabilizers disclosed herein may include an aerodynamic, contoured profile that helps to minimize the effects of crosswinds contacting the stabilizer. In at least one example, the stabilizer has a generally elliptical cross-sectional shape. The elliptical cross-sectional shape has a greater width than a height dimension. The low profile, relatively aerodynamic design of the example stabilizers disclosed herein may make it possible to increase the size (i.e., the length and circumferential dimensions) of the stabilizer without increasing the negative effects of crosswinds as compared to stabilizers of a different cross-sectional shape such as a circular cross-sectional shape.

Reference is made in the following to a number of illustrative embodiments of the subject matter described herein. The following embodiments illustrate only a few selected embodiments that may include the various features, characteristics, and advantages of the subject matter as presently described. Accordingly, the following embodiments should not be considered as being comprehensive of all of the possible embodiments. Also, features and characteristics of one embodiment may and should be interpreted to equally apply to other embodiments or be used in combination with any number of other features from the various embodiments to provide further additional embodiments, which may describe subject matter having a scope that varies (e.g., broader, etc.) from the particular embodiments explained below. Accordingly, any combination of any of the subject matter described herein is contemplated.

Referring now to FIG. 1, an exemplary archery bow 10 is shown including a stabilizer 50 extending from a front surface thereof. The archery bow 10 includes a handle assembly 12, a bowstring 14, cables 16, 17, a pair of pulleys 18, 20, and a cable guard assembly 22. The handle assembly 12 includes a riser 24 and upper and lower limbs 26, 28 that support the pulleys 18, 20, respectively. The riser 24 includes a rear side 30 facing the bowstring 14, and a front side 32 facing in a direction opposite the bowstring 14. The cable guard assembly 22 includes a shaft 46 and a cable slide 48 that engages the cable 16.

The archery bow 10 may further include a quiver 40 that retains a plurality of arrows (not shown). The archery bow 10 may also include a plurality of bowstring dampeners 42 mounted to the bowstring 14. A plurality of vibrations dampeners 44 may be mounted to the handle assembly 12 (e.g., along the riser 24 and upper and lower limbs 26, 28). Those skilled in the art will understand that an archery bow stabilizer as described and claimed herein may be used with any type of archery bow (e.g., compound or traditional).

A stabilizer 50 may be mounted to the handle assembly 12 to provide a stabilizing and balancing function for the archery bow 10. The stabilizer 50 may be mounted along the front side 32 of the riser 24. The stabilizer 50 may extend in an XY plane wherein the X direction is generally in a forward direction. The forward direction may also be referred to as a direction of arrow travel or a direction of bowstring movement. The Y direction may be referred to as a lateral direction or a direction that is perpendicular to both a direction of arrow travel and a length dimension of the bow (i.e., a length dimension of the handle assembly 12 between upper and lower limbs 26, 28). The Z direction may be defined as a direction along the length of the bowstring 14 or a length dimension of the archery bow such as a length measured between the pulleys 18, 20.

A stabilizer 50 may be positioned within the XY plane and extend generally in the X direction. Many other arrangements are possible for the stabilizer 50. For example, the stabilizer 50 may be positioned within the XZ plane and extend in a direction that is arranged at an angle relative to the X direction.

Referring now to FIGS. 1-4, the stabilizer 50 includes a proximal end 52, a distal end 54, and an attachment portion 56 positioned at the proximal end 52. The attachment portion 56 may be constructed as a projection such as a threaded shank. The attachment portion 56 may contact a mating attachment feature positioned on the handle assembly 12 such as along the front side 32 of the riser 24. In one example, an attachment aperture (not shown) is positioned on the riser 24 for receiving the attachment portion 56. The attachment aperture may include a threaded bore that mates with a threaded shank of the attachment portion 56 to releasably mount the stabilizer 50 to the handle assembly 12. Other attachment features are possible for mounting the stabilizer 50 to the handle assembly 12.

The stabilizer 50 may have a length L (also referred to as a longitudinal or length dimension) measured between the proximal and distal ends 52, 54. The stabilizer 50 may also have a minor axis $A_1$, a major axis $A_2$, and a longitudinal axis $A_3$ (see FIGS. 3 and 4). Typically, when the archery bow 10 is in an upright position prepared for use, the minor axis $A_1$ is aligned with the Z axis, the major axis $A_2$ is aligned with the Y axis, and the longitudinal axis $A_3$ is aligned with the X axis shown in FIG. 1.

Figure 2:
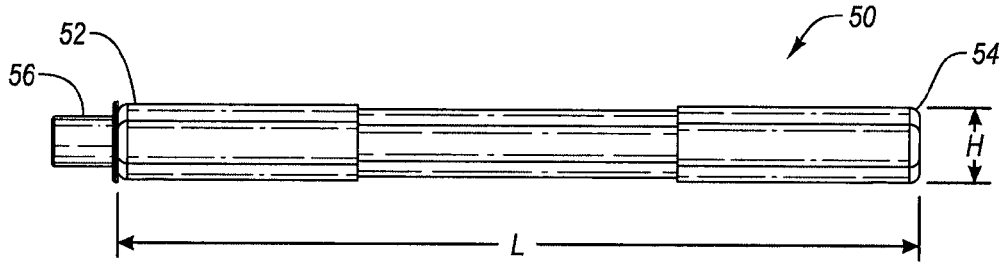
FIG. 2 is a side view of the stabilizer shown in FIG. 1.
Figure 3:
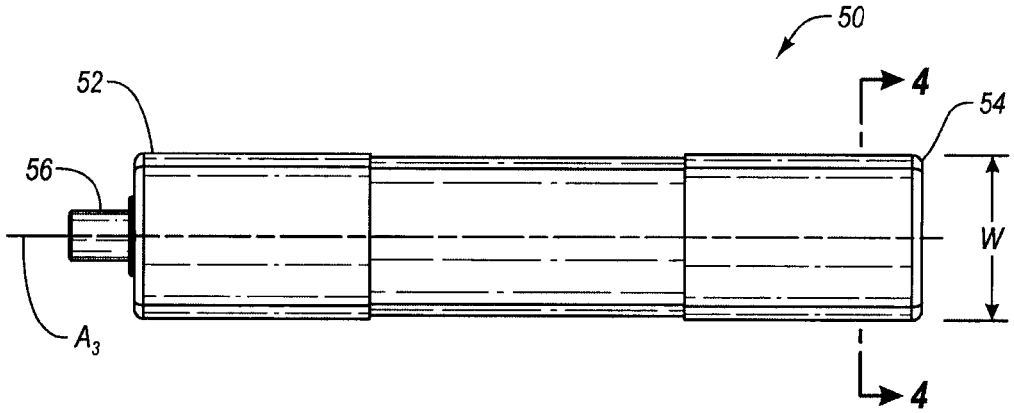
FIG. 3 is a top view of the stabilizer shown in FIG. 1.

The stabilizer 50 has a height H (see FIG. 2), a width W (see FIG. 3), and a length L (see FIG. 2). The height H is measured along the minor axis $A_1$. The width W is measured along the major axis $A_2$. The width W is greater than the height H to provide a reduce profile for the stabilizer 50 in the lateral direction (see FIG. 4). In some arrangements, a height H to width W ratio is less than 1.0 and is typically in the range of about 0.35 to about 0.60, more preferably about 0.38 to about 0.46, and most preferably about 0.419, as described in more detail below.

Figure 4:
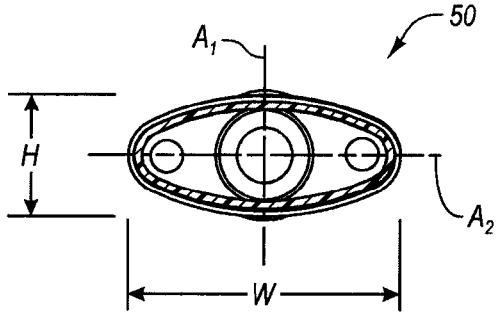
FIG. 4 is a cross-sectional view of the stabilizer shown in FIG. 3 taken along cross-section indicators 4-4.

The outer peripheral surface of the stabilizer 50 may be generally contoured or curved as shown in at least the cross-sectional view of FIG. 4. Alternatively, at least some portions of the outer periphery of the stabilizer 50 may include one or more linear or planer surfaces.

The cross-sectional shape of the stabilizer 50 may be generally oval or elliptical shape. Other cross-sectional shapes are possible for the stabilizer 50 that provide a maximum width dimension W that is greater than a maximum height dimension H. For example, the stabilizer 50 may have a rectangular, triangular, quadrilateral, or polygonal cross-section shape or portion. The contoured shape of the stabilizer 50 may improve the aerodynamics of the stabilizer 50 in the presence of environmental conditions such as crosswinds and headwinds.

The cross-sectional shape of the stabilizer 50 may be constant or may very along the length L. For example, at one location adjacent to the proximal end 52, the stabilizer 50 may have a generally circular cross-sectional shape, while at a different location, for example adjacent to the distal end 54, the stabilizer 50 may have a oval or elliptical shape cross-section. A smooth transition may occur between various cross-sectional shapes of the stabilizer 50 along its length L.

Referring now to FIGS. 5-8, a stabilizer assembly is shown having other stabilizer components in addition to the stabilizer 50 shown in FIGS. 1-4. The stabilizer assembly may include an extension 58 and first and second legs 60, 62 that are mounted to an extension base 64 at the distal end 54 of the stabilizer 50. The extension 58 includes proximal and distal ends 70, 72. Each of the first and second legs 60, 62 includes proximal and distal ends 74, 76. The first and second legs 60, 62 are mounted to the extension base 64 at the distal ends 76. The first and second legs 60, 62 extend in a generally proximal or rearward direction toward the handle assembly 12. The extension 58 is connected to the extension base 64 at its proximal end 70. The extension 58 may extend in a generally distal or forward direction away from the handle assembly 12.

Figure 5:
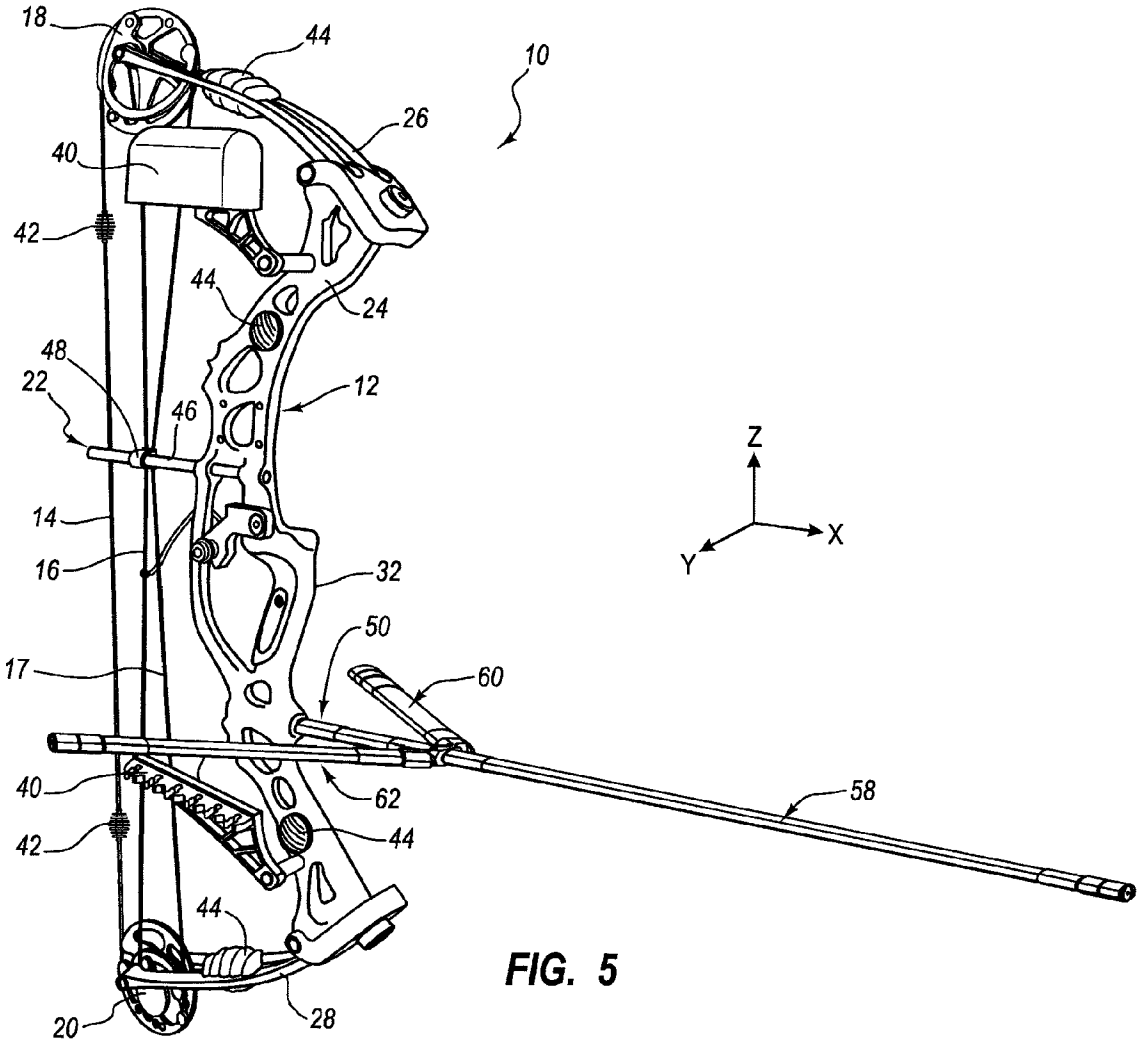
FIG. 5 is a perspective view of a bow having an example stabilizer assembly in accordance with the present disclosure.
Figure 6:
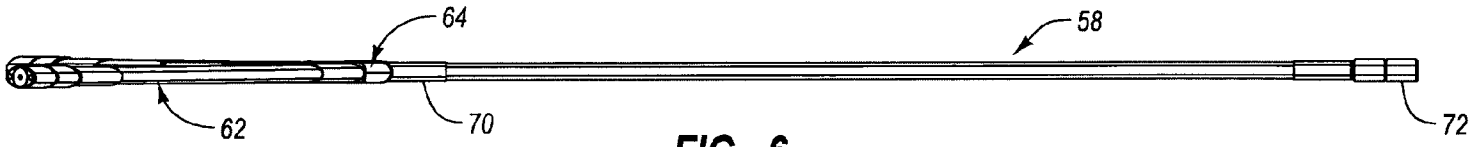
FIG. 6 is a side view of the stabilizer assembly shown in FIG. 5.
Figure 7:
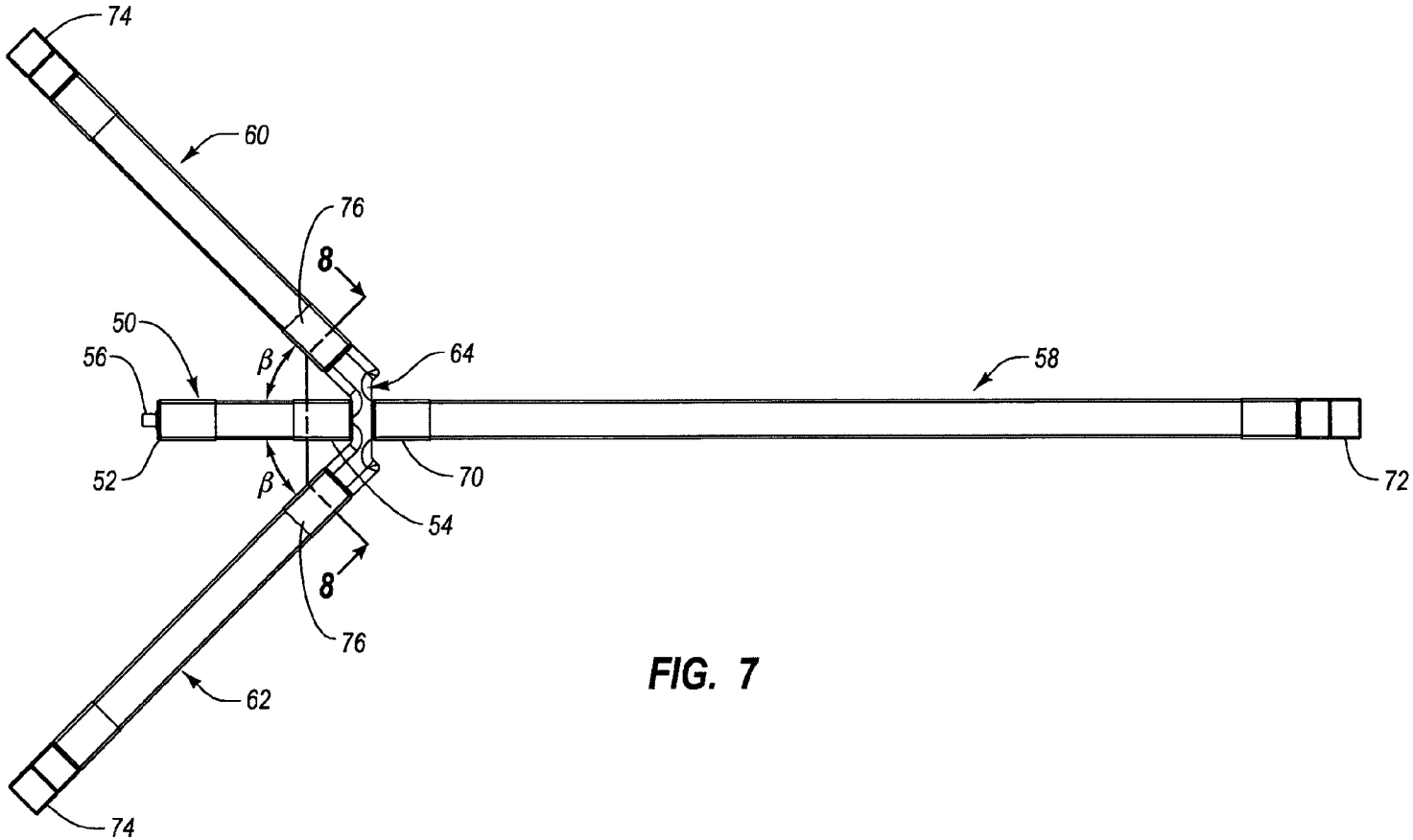
FIG. 7 is a top view of the stabilizer assembly shown in FIG. 5.
Figure 8:
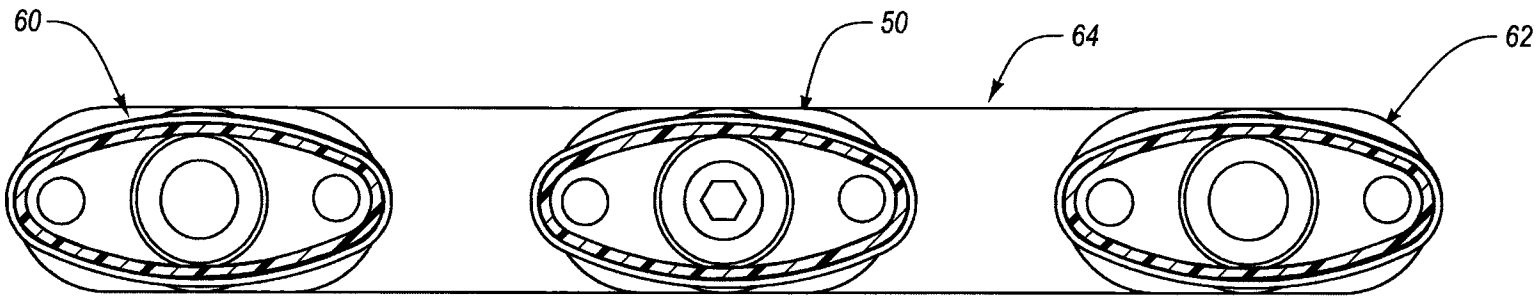
FIG. 8 is a cross-sectional view of the stabilizer assembly shown in FIG. 7 taken along cross-section indicators 8-8.

The extension 58 and first and second legs 60, 62 may each have a cross-sectional shape that is similar to that of the stabilizer 50 (e.g., see cross-sectional shape of first and second legs 60, 62 in FIG. 8). Any one of the extension 58 and first and second legs 60, 62 may have a unique cross-sectional shape, size, length and arrangement relative to the XYZ coordinates shown in FIG. 5 as compared to the other components of the stabilizer 50. In the arrangement of FIG. 5, the stabilizer 50 and extension 58 are arranged within the XZ plane and extend generally in the X direction from the handle assembly 12. The first and second legs 60, 62 are arranged in the XY plane and extend at an angle beta (β) relative to the X direction (i.e., at a 45 degree angle β relative to the X direction shown in FIG. 7). In at least some arrangements, the proximal end 74 of the first and second legs 60, 62 extend proximal of the proximal end 52 and stabilizer 50 (see FIG. 7).

Many other stabilizer assemblies having a variety of legs, extensions, base numbers and other features may be possible for use with or in place of the stabilizer 50. Typically, at least a portion of the stabilizer assembly includes a smaller profile when viewed from the lateral or side direction (i.e., viewing in the Y direction) as compared to in a vertical up and down direction (i.e., viewing in the Z direction). At least a portion of the stabilizer assembly may include an oval or elliptical shape. At least a portion of the stabilizer assembly may have a smaller maximum dimension in the Z direction (i.e., in a direction along the length of the handle assembly 12, which is also referred to as the vertical direction or a direction along a minor axis $A_1$) than in the Y direction (also referred to as a lateral direction or a direction along a major axis $A_2$). The stabilizer may have a constant cross-sectional shape along its entire length. In other arrangements, the stabilizer may have a variable cross-sectional shape along its length, wherein at least a portion of the stabilizer has a cross-sectional shape with a maximum dimension along a minor axis that is smaller than a maximum direction along a major axis arranged perpendicular to the minor axis (i.e., a greater width W than height H).

The cross-sectional shape of the stabilizer may be characterized as being non-circular. In other arrangements, the cross-sectional shape of the stabilizer may be defined as an oblong shape. The outer peripheral surface of the stabilizer may be defined as having a varying radius of curvature around the circumference or periphery of the stabilizer. For example, referring to FIG. 4, the radius of curvature along opposing side surfaces is smaller than the radius of curvature along the top and bottom surfaces of the stabilizer. The outer peripheral surface may also be defined as having a rectilinear or curvilinear shape.

The stabilizer may have an outer profile that is shaped similar to an air foil or other aerodynamic shape. At least a portion of the stabilizer cross-sectional shape may include at least a portion of an air foil shape or other aerodynamic shape that improves air flow over the stabilizer in at least a lateral direction.

It should be appreciated that the stabilizer 50 may be used with any suitable bow. The archery bow 10 is shown as one example of a type of bow that is suitable to be used with the stabilizer 50. Other bows that may benefit from the stabilizer 50 include other compound bows, recurve bows, long bows, crossbows and the like.

Referring now to FIGS. 9-16, another example stabilizer 150 is shown and described. The stabilizer 150 includes a proximal end 152, a distal end 154, and an attachment portion 156 positioned at the proximal end 152. The stabilizer 150 has a length L (see FIG. 9), a minor axis $A_1$ (see FIG. 13), a major axis $A_2$ (see FIG. 13), and a longitudinal axis $A_3$ (see FIG. 9). A cross-section of a shaft portion 157 of the stabilizer 150 (see FIG. 14) has a height H and a total width $W_1$. The cross-section has a minimum radius $R_1$ on opposing sides of the shaft portion 157, and a maximum radius $R_2$ along top and bottom surfaces. A distance between the axes of the radiuses $R_1$ has a width $W_2$.

Figure 9:
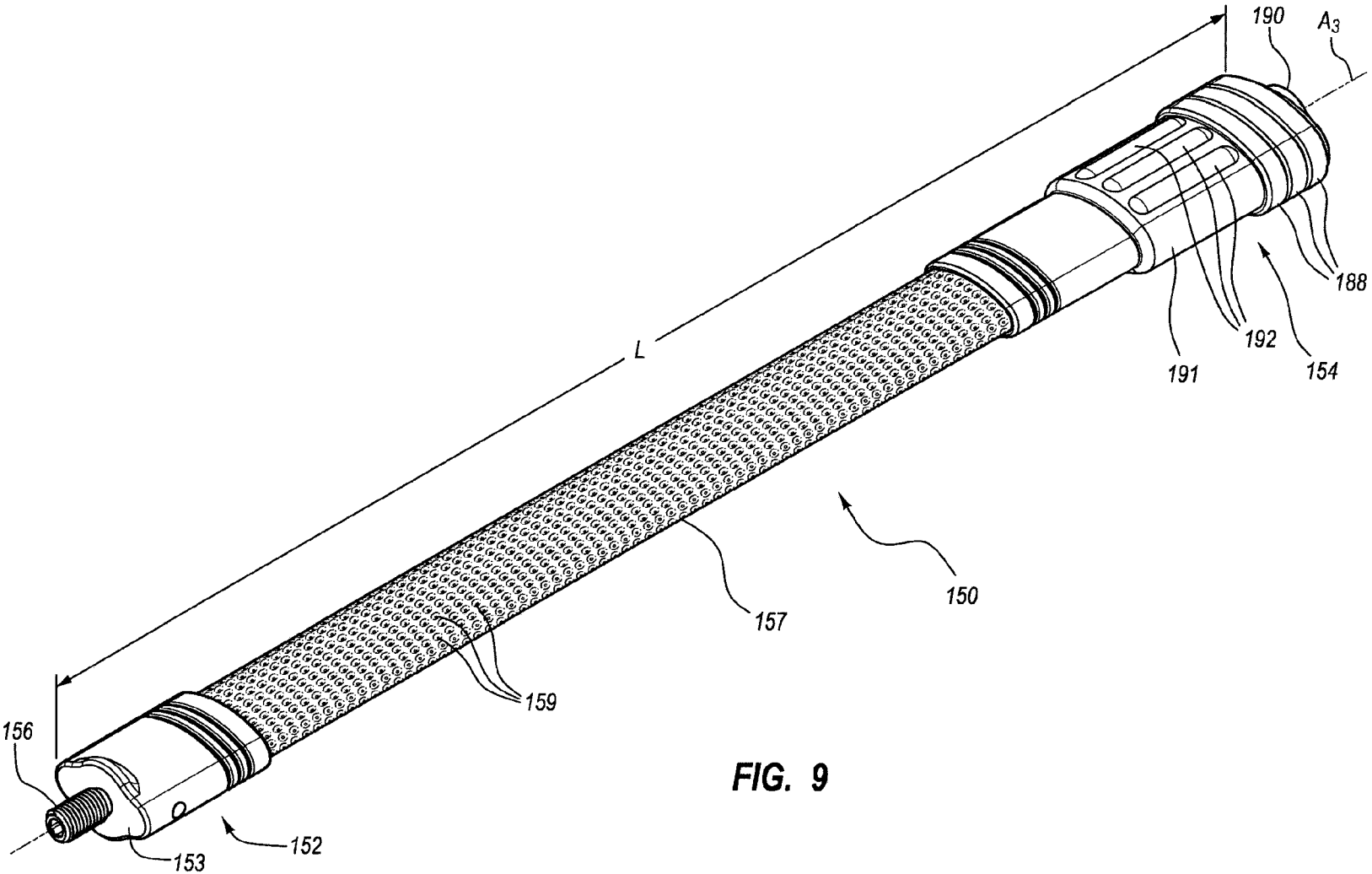
FIG. 9 is a perspective view of another example stabilizer in accordance with the present disclosure.
Figure 11:
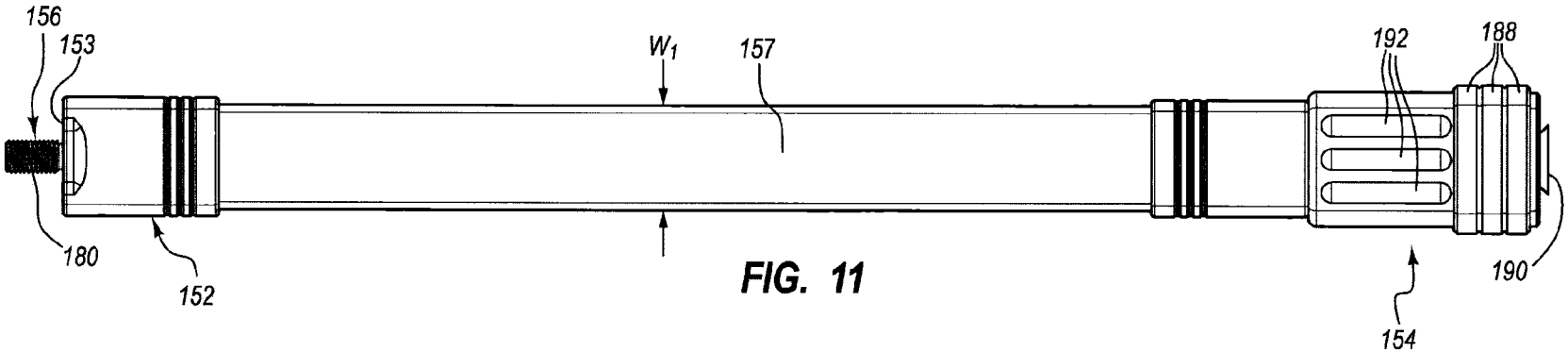
FIG. 11 is a top view of the stabilizer of FIG. 9.
Figure 10:
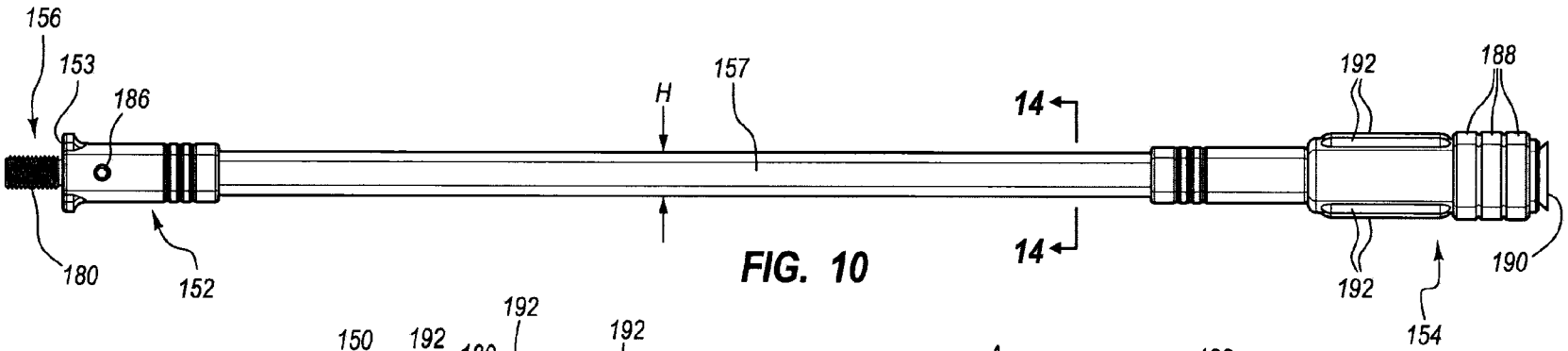
FIG. 10 is a side view of the stabilizer of FIG. 9.
Figure 13:
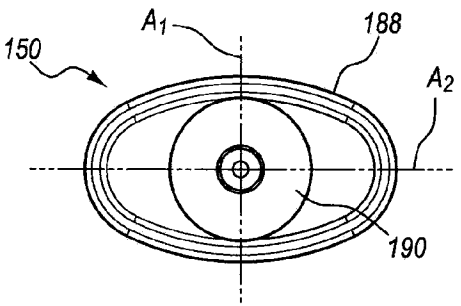
FIG. 13 is a front view of the stabilizer of FIG. 9.
Figure 12:
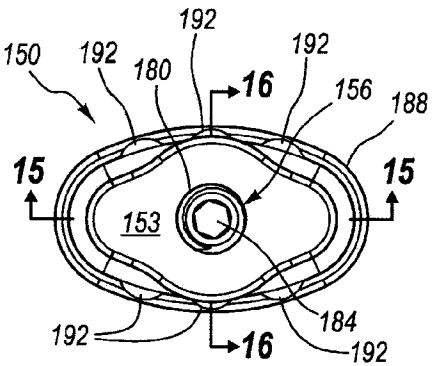
FIG. 12 is a rear view of the stabilizer of FIG. 9.
Figure 14:
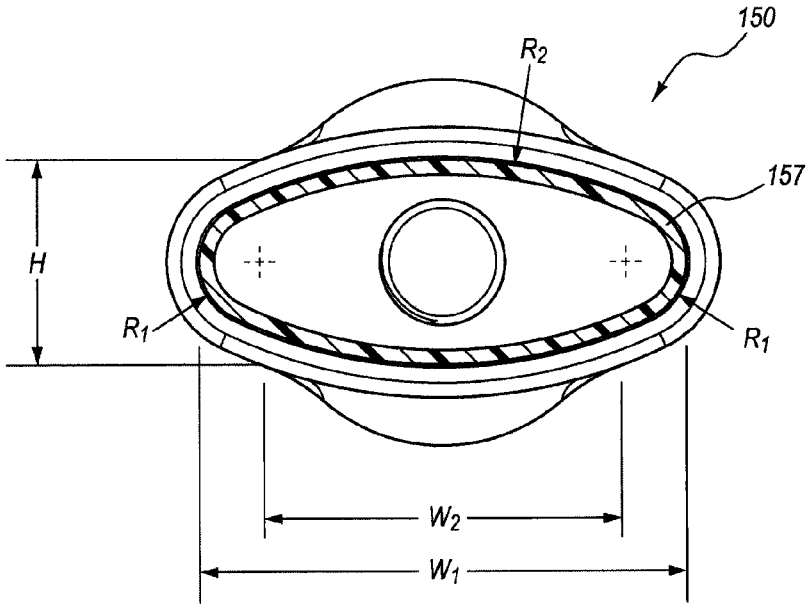
FIG. 14 is a cross-sectional view of the stabilizer of FIG. 10 taken along cross-section indicators 14-14.

The stabilizer 150 may include a dimpled finish on at least some features of the stabilizer 150. For example, the shaft portion 157 may include a plurality of dimples 159 along an exterior surface thereof as shown in FIG. 9. The dimples 159 may improve aerodynamic performance of the stabilizer 150. The dimples 159 may be added to any of the features of any of the embodiments disclosed herein.

In one embodiment, the height H is in the range of about 0.2 inches to about 2 inches, more preferably in the range of about 0.3 inches to about 0.8 inches, and most preferably about 0.4 to about 0.5 inches. The width $W_1$ may be in the range of about 0.5 inches to about 3 inches, more preferably about 0.8 to about 1.5 inches, and most preferably about 0.9 to about 1.1 inches. Example height-to-width ratios are discussed below. The radius $R_1$ is typically in the range of about 0.05 inches to about 0.5 inches, more preferably about 0.1 inches to about 0.2 inches, and most preferably about 0.1 inches to about 0.15 inches. The radius $R_2$ is typically in the range of about 0.5 inches to about 3 inches, more preferably about 0.8 inches to about 1.5 inches, and most preferably about 0.9 inches to about 1.1 inches.

The stabilizer 150 may include a plurality of distal weights 188 positioned at the distal end 154. A separate dampener 191 having a plurality of surface dampeners 192 may also be positioned at the distal end 154 and connected to the shaft portion 157 with a fastener 193. A distal fastener 190 may be used to connect the distal weights 188 to the shaft portion 157 or to the dampener 191.

Figure 15:
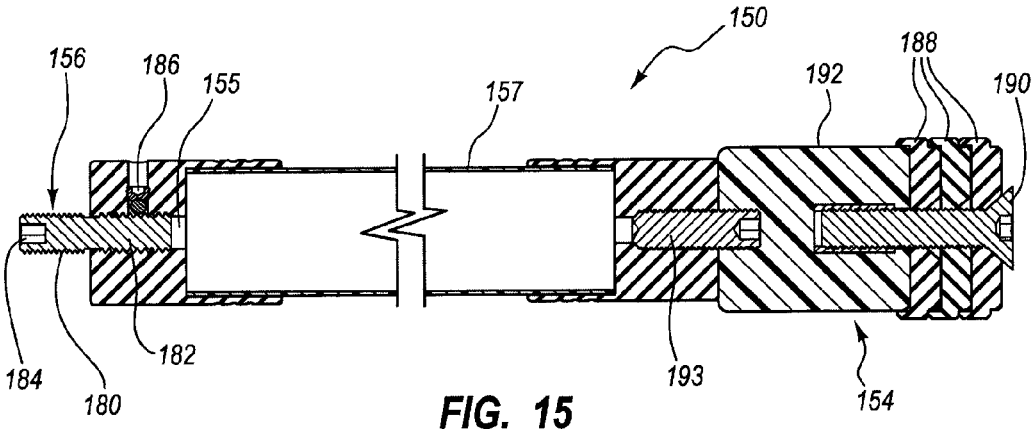
FIG. 15 is a cross-sectional view of the stabilizer of FIG. 12 taken along cross-section indicators 15-15.
Figure 16:
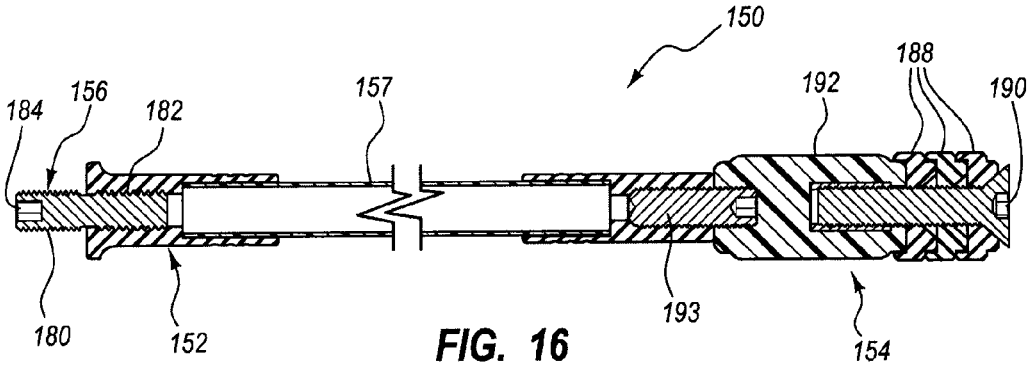
FIG. 16 is a cross-sectional view of the stabilizer of FIG. 12 taken along cross-section indicators 16-16.

The attachment portion 156 of the stabilizer 150 may include a first threaded portion 180, a second threaded portion 182, a tool interface 184, and a set screw 186 (see FIGS. 15 and 16). The attachment portion 156 may be configured to provide a rotational adjustment and mounting of the stabilizer 150 relative to the archery bow 10 to which the stabilizer 150 is attached. The elliptical cross-sectional shape of the stabilizer 150 is usually preferably mounted with the minor axis $A_1$ closely aligned with a length dimension of the archery bow 10. The attachment portion 156 provides an adjustable mounting of the stabilizer 150 to the archery bow 10 so that when the stabilizer 150 is rotated into a stop or final position relative to the archery bow 10, the minor axis $A_1$ is aligned with the length dimension of the archery bow 10. The attachment portion 156 may also permit adjustable mounting of the stabilizer 150 to the archery bow 10 with the minor axis $A_1$ skewed or offset relative to the length dimension of the archery bow 10, for example, to optimize performance in know environmental conditions.

Figure 17:
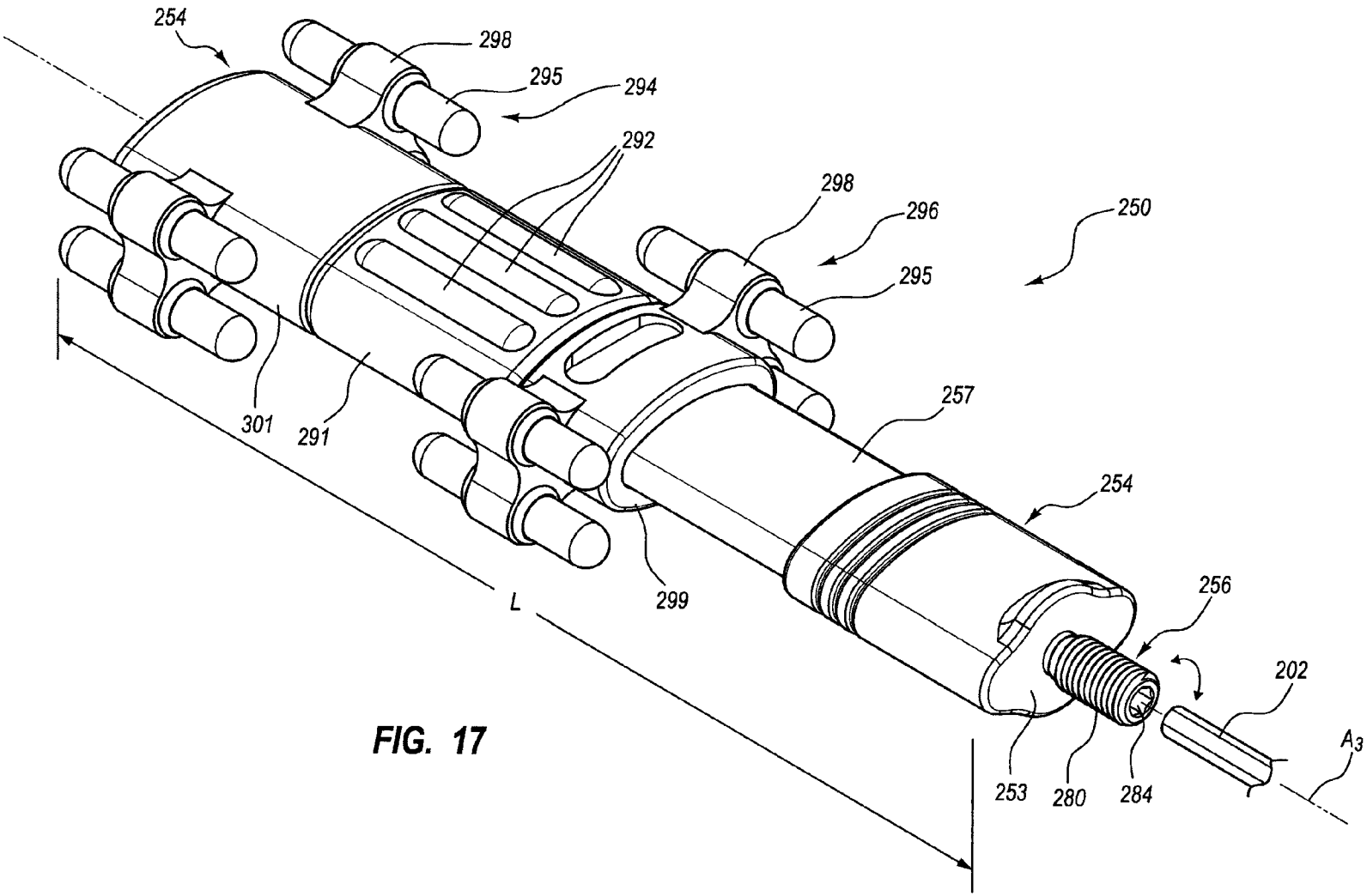
FIG. 17 is a perspective view of another example stabilizer in accordance with the present disclosure.
Figure 18:
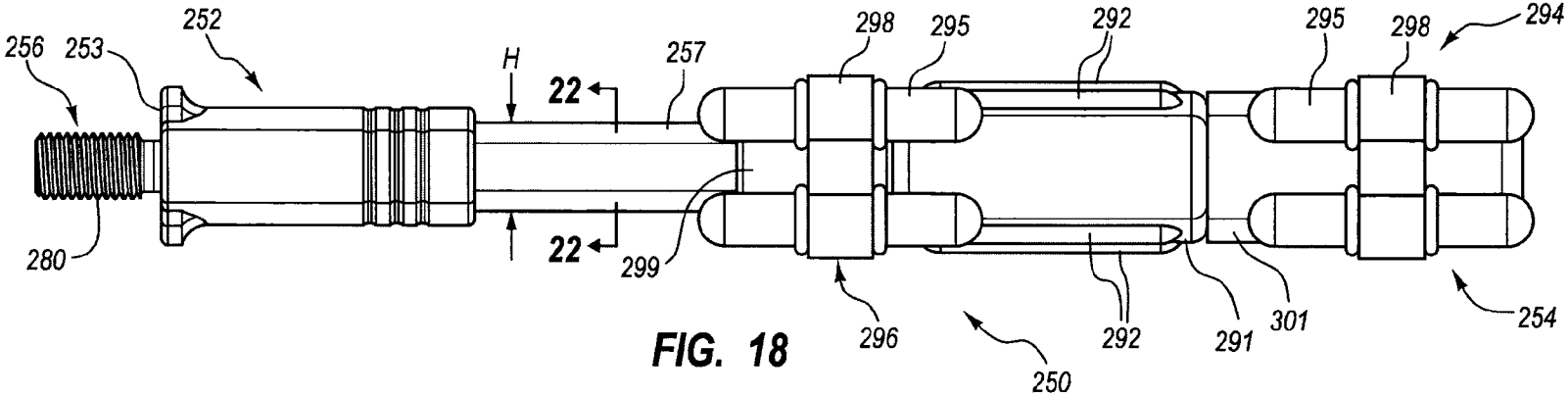
FIG. 18 is a side view of the stabilizer of FIG. 17.
Figure 19:
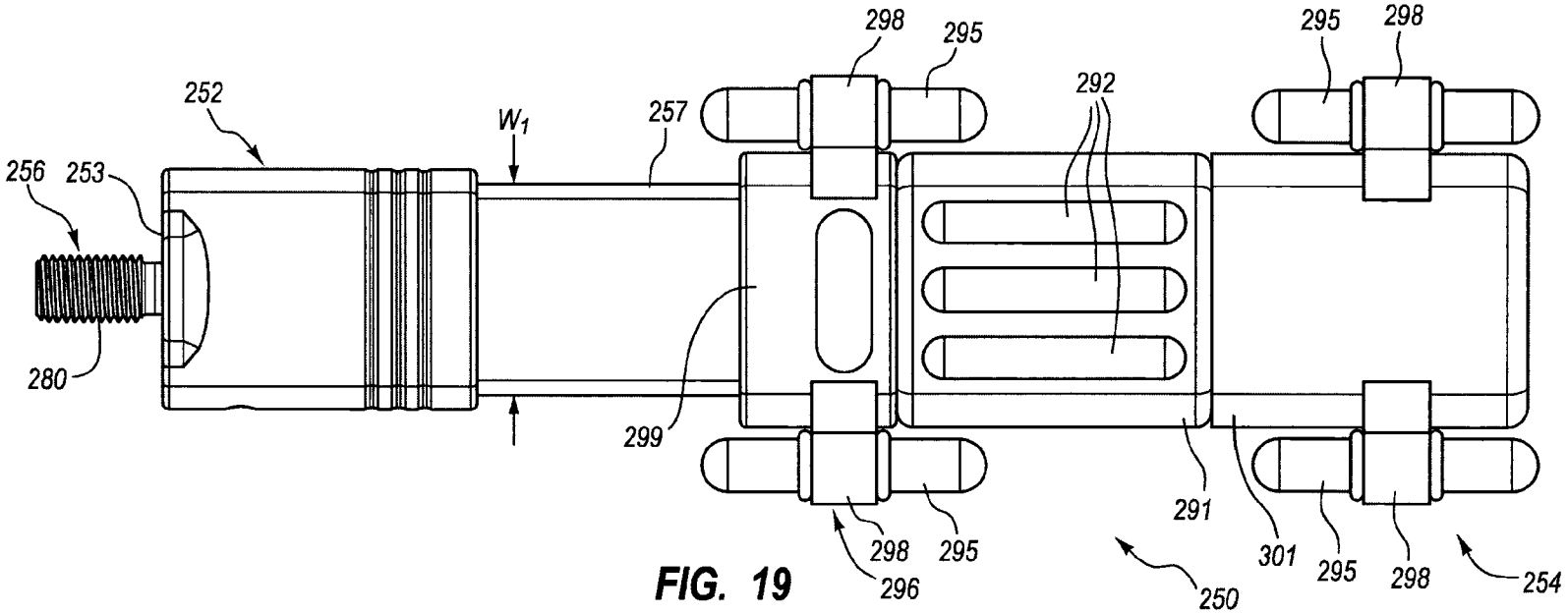
FIG. 19 is a top view of the stabilizer of FIG. 17.
Figure 20:
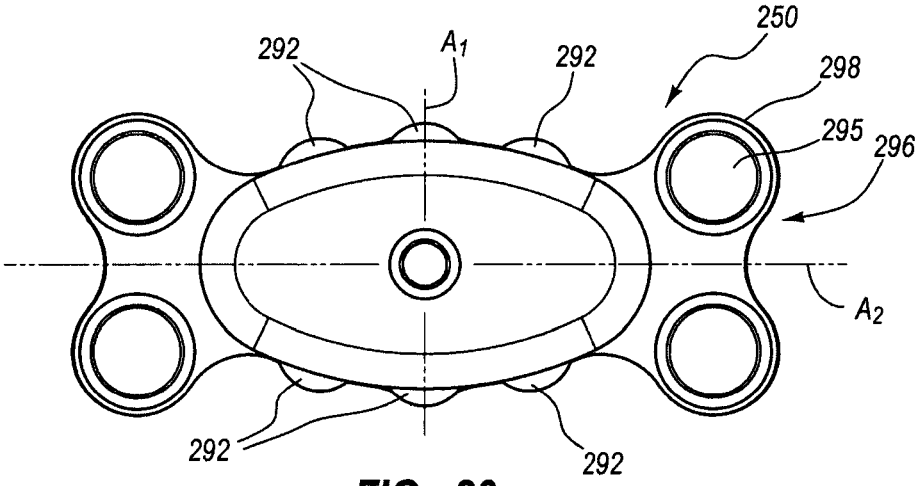
FIG. 20 is a front view of the stabilizer of FIG. 17.
Figure 21:
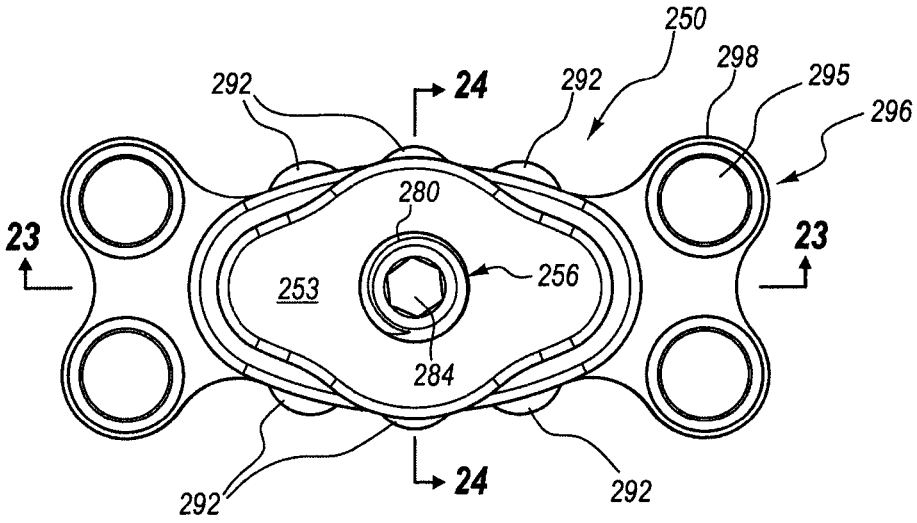
FIG. 21 is a rear view of the stabilizer of FIG. 17.
Figure 22:
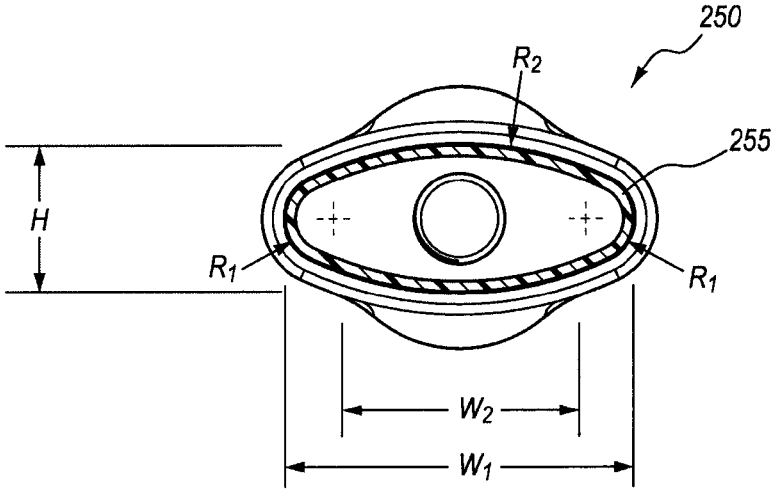
FIG. 22 is a cross-sectional view of the stabilizer of FIG. 18 taken along cross-section indicators 22-22.
Figure 23:
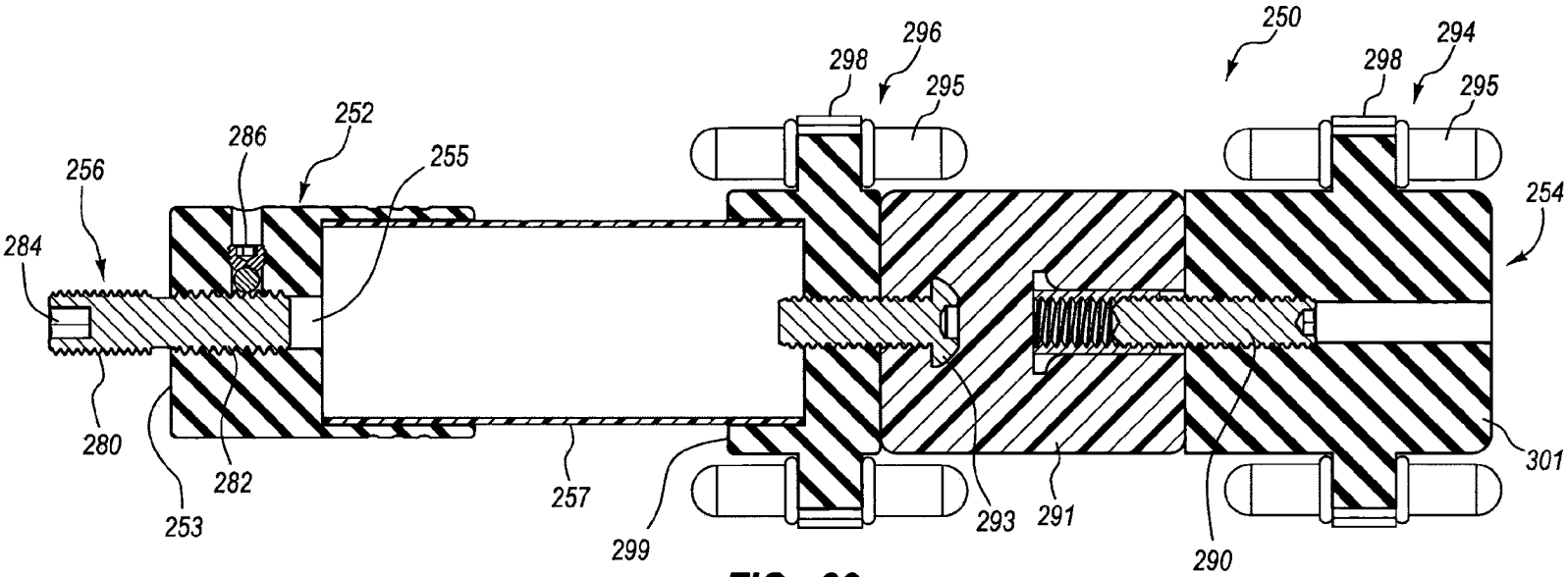
FIG. 23 is a cross-section view of the stabilizer of FIG. 21 taken along cross-section indicators 23-23.
Figure 24:
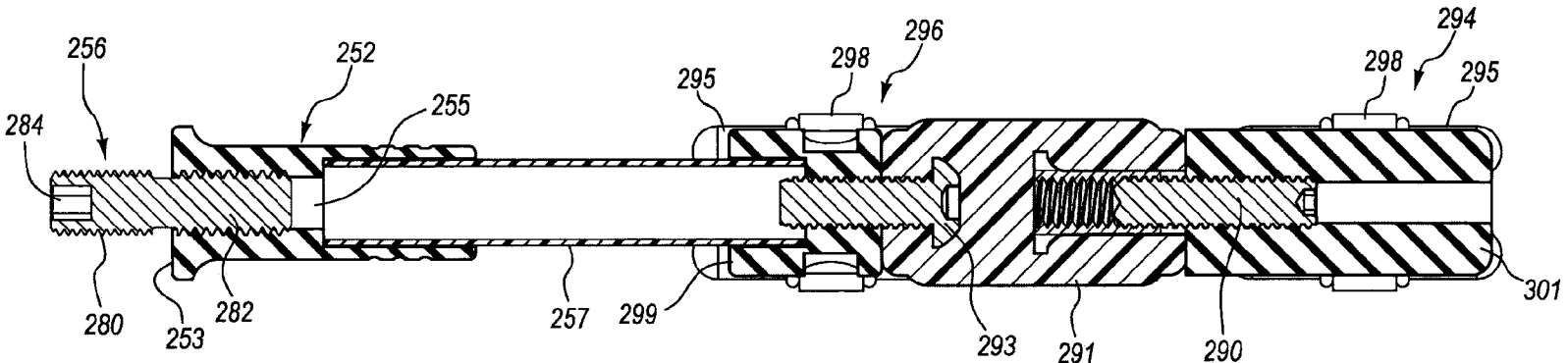
FIG. 24 is a cross-sectional view of the stabilizer of FIG. 21 taken along cross-section indicators 24-24.

The first threaded portion 180 may be used to threadably connect to a threaded bore of the archery bow 10, or a bracket or mounting structure having a threaded bore and that interfaces between the archery bow 10 and the attachment portion 156. The second threaded portion 182 may be threadably connected to a threaded aperture 155 at the proximal end 152 of the stabilizer 150. The tool interface 184 may be configured to receive a tool 202 (see FIG. 17), to rotate the attachment portion 156 within the threaded aperture 155. The set screw 186 may be operated to fix a rotated position of the second threaded portion 182 relative to the threaded aperture 155.

In operation, the second threaded portion 182 is threaded to a desired depth within the threaded aperture 155. The first threaded portion 180 is then threadably received within a threaded bore of the archery bow 10 and the stabilizer 150 is rotated until a bow contact surface 153 at the proximal end 152 contacts the archery bow 10 to provide a rotation stop position for the stabilizer 150. If the minor axis $A_1$ of the stabilizer 150 is not aligned with the length dimension of the archery bow 10 in the stop position, then the first threaded portion 180 is unthreaded from the threaded bore of the archery bow 110 and the second threaded portion 182 is rotated with the tool 202 in a clockwise or counter-clockwise direction that correlates with the amount of rotation needed to align the minor axis $A_1$ with the length dimension of the archery bow 10. The set screw 186 may be operated at any point to help fix the rotated position of the second threaded portion 182 within the threaded aperture 155. The first threaded portion 180 is then rotatably received within a threaded bore of the archery bow 10 until the stop position of the stabilizer 150 relative to the archery bow 10 is achieved. These adjustment steps are continued until the minor axis $A_1$ is aligned with the length dimension of the archery bow 10.

In some arrangements, the first and second threaded portions 180, 182 have different thread pitches so that, for example, one full rotation of the second threaded portion 182 within the threaded aperture 155 correlates to a half rotation of the first threaded portion 180 relative to the threaded bore of the archery bow 10. Additional details concerning an example attachment feature having similar features to the attachment portion 156 is included in the blade alignment technology (B.A.T.) sold by Sullivan Industries and used to tune rotated mounting of broadheads to carbon arrows.

Referring now to FIGS. 17-24, another example stabilizer 250 is shown and described. The stabilizer 250 includes a proximal end 252, a distal end 254, and an attachment portion 256. The stabilizer 250 also has a length L (see FIG. 17), a minor axis $A_1$ (see FIG. 20), a major axis $A_2$ (see FIG. 20), and a longitudinal axis $A_3$ (see FIG. 17). A cross section of the stabilizer 250 shown in FIG. 22 includes a height H, a total width $W_1$, a minor radius $R_1$, and a major radius $R_2$. A distance between central axes of the radiuses $R_1$ may have a width $W_2$.

The stabilizer 250 may also include a plurality of dampener members positioned at a distal end 254 to stabilizer 250. For example, the stabilizer 250 may include first and second sets of dampeners 294, 296. Each of the sets of dampeners 294, 296 may include at least one suspended dampener members 295 retained by a coupling structure 298. The suspended dampeners 295 may be arranged as cantilever dampener members that are mounted in a cantilever fashion, wherein at least one end of the suspended dampeners 295 is free and unsupported. The suspended dampeners 295 may be mounted to the coupling structure 298 at a midpoint along a length of the suspended dampeners 295.

The first and second sets of dampeners 294, 296 may be mounted to the stabilizer 250 with dampener mounts 301, 299, respectively. Distal and mid-fasteners 290, 293 may be used to connect the dampener mounts 299, 301 to the stabilizer 250 (see FIGS. 23 and 24). A separate dampener member 291 may be interposed between the dampener mounts 299, 301. The dampener 291 may include a plurality of surface dampener structures 292.

In other arrangements, any one of the dampener mounts 299, 301 or dampener 291 may be removed or rearranged relative to each other. Some embodiments include only a single one of the first and second sets of dampeners 294, 296. The dampener 291 may have different constructions include different numbers or configurations of surface dampener structures 292.

The suspended dampeners 295 may be radially spaced apart around a circumference of the stabilizer 250. In some arrangements, the suspended dampeners 295 are arranged in pairs or sets with offset spacing of the pairs or sets around the circumference of the stabilizer 250. In other arrangements, the suspended dampeners 295 are equally spaced apart around the circumference of the stabilizer 250.

The sets of dampeners 294, 296 and dampener mounts 299, 301 of stabilizer 250 may be used in any of the other stabilizer embodiments disclosed herein, including stabilizers 50, 150. The suspended dampeners 295 may provide dampening of vibrations within the archery bow 10 during use. In some examples, the dampener structures 292, 295 may provide both a stabilizing function and dampening function.

The attachment portion 256 may include first and second threaded portions 280, 282, a tool interface 284 configured to interface with a tool 202, and a set screw 286 to help fix a position of the second threaded portion 282 relative to the stabilizer 250. The stabilizer may include a bow contact surface 253 at the proximal end 252, and a threaded aperture 255 also positioned at the proximal end 252. The attachment portion 256 may operate in the same or similar manner as the attachment portion 156 described above. The attachment portion 256 may assist in providing rotational alignment of the stabilizer 250 relative to the archery bow 10.

Other types of attachment features or systems may be used to help align the stabilizers disclosed herein relative to the archery bow. Many types of attachment features may be implements to adjust a final stop position of the stabilizer relative to the archery bow to provide rotational alignment of the stabilizer relative to a feature (e.g. a length dimension) of the archery bow.

In one example, an interface between the first threaded portion of the attachment portion with the threaded aperture of the archery bow has a greater resistance to rotation than a threaded interface between the second threaded portion and the threaded aperture of the stabilizer. In other arrangements, the resistance to rotation or an amount of friction provided by the first and second threaded portions are different so that rotation of one of the threaded portions within its respective threaded bore does not occur while threading the other of the threaded portions within its respective threaded bore. This difference in resistance to rotation may result from, for example, a pitch angle, surface finish, or material composition used for the threaded portions.

Figure 25:
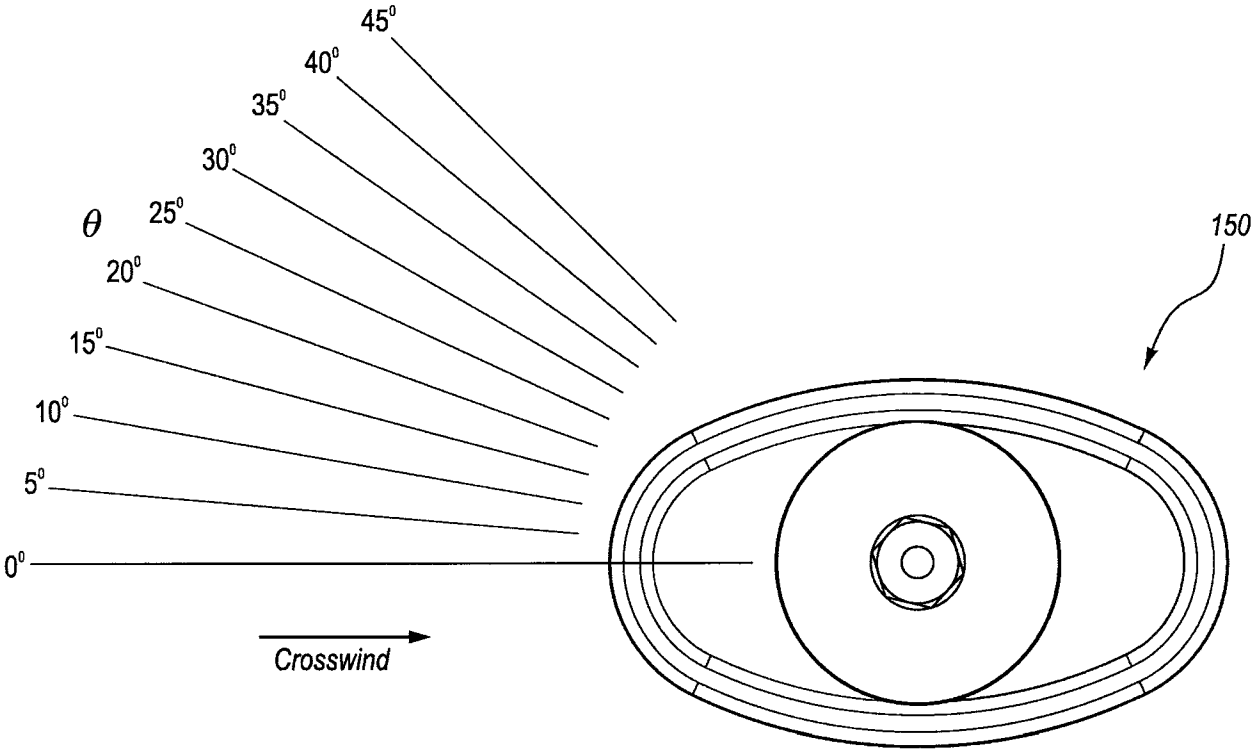
FIG. 25 is a front view of the stabilizer of FIG. 9 showing different crosswind angles.
Figure 26:
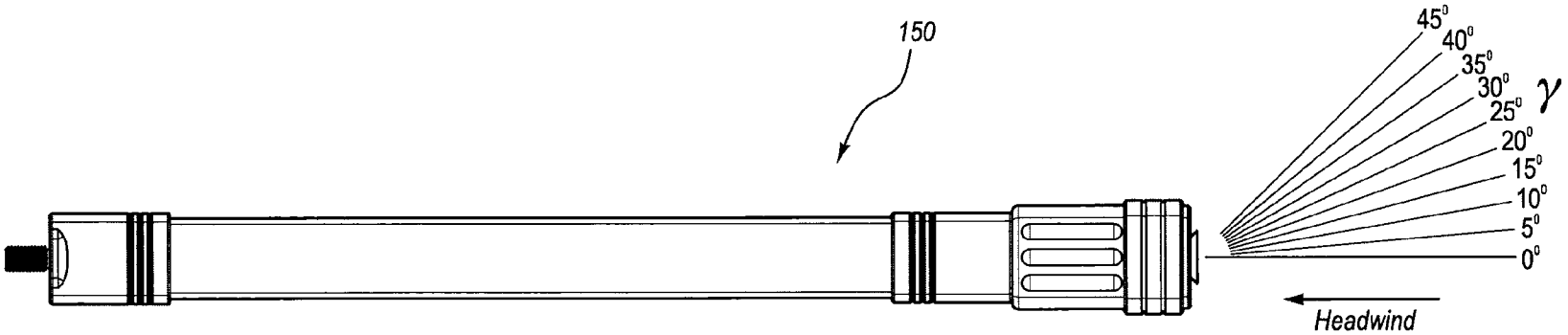
FIG. 26 is a top view of the stabilizer of FIG. 9 showing different headwind angles.

A height-to-width ratio of the stabilizers disclosed herein may provide certain advantages related to, for example, a drag coefficient that exists in the presence of wind conditions. For example, the stabilizer may be exposed to a headwind at a given headwind angle $\gamma$ as shown in FIG. 26. The stabilizer may be exposed to a crosswind at a crosswind angle $\theta$ as shown in FIG. 25. The height-to-width ratio may influence to an amount of force applied by the headwind or crosswind to the stabilizer within angles $\gamma$, $\theta$ typically experienced in actual operation of the archery bow 10.

Figure 27:
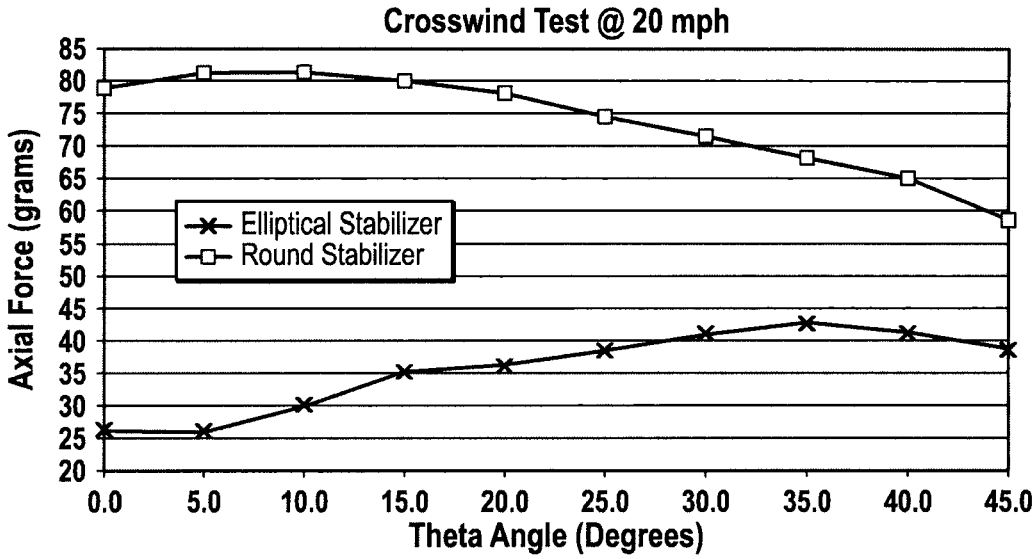
FIG. 27 is a graph showing crosswind test results for stabilizers with circular vs. elliptical shape.

Referring to FIG. 27, test data are shown in graph format related to an amount of force applied to a stabilizer by a crosswind, wherein the stabilizer has a height-to-width ratio less than 0.6 (i.e., an oval or elliptical cross section) as compared to a stabilizer having a height-to-width ratio of 1.0 (i.e., a round cross section). FIG. 27 represents application of a 20 miles per hour crosswind at angles ranging from $\theta=0°$ to $\theta=45°$. The data shown in FIG. 27 illustrate a significant reduction in force applied to the stabilizer by the crosswind at all angles between $\theta=0°$ and $\theta=45°$ compared to an amount of force applied to the circular stabilizer.

Figure 28:
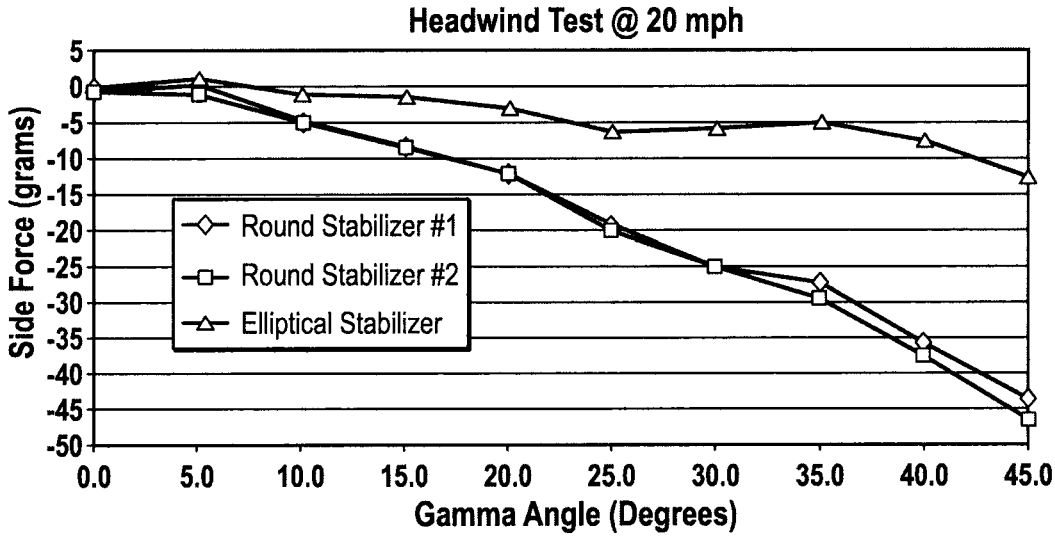
FIG. 28 is a graph showing headwind test data for stabilizers with circular vs. elliptical shape.

FIG. 28 illustrates the forces applied to the stabilizer upon application of a headwind of 20 miles per hour to a stabilizer at angles between $\gamma=0°$ and $\gamma=45°$. The data shown in FIG. 28 illustrate that the greater the angle $\gamma$ of the headwind, the greater a difference of applied force between an oval or elliptical cross section stabilizer (height-to-width ratio less than 1.0), and a round cross section stabilizer (height-to-width ratio of 1.0). The greater the angle of the applied headwind in FIG. 28, the greater a difference between the applied force in the oval or elliptical and round cross section stabilizers.

Figure 29:
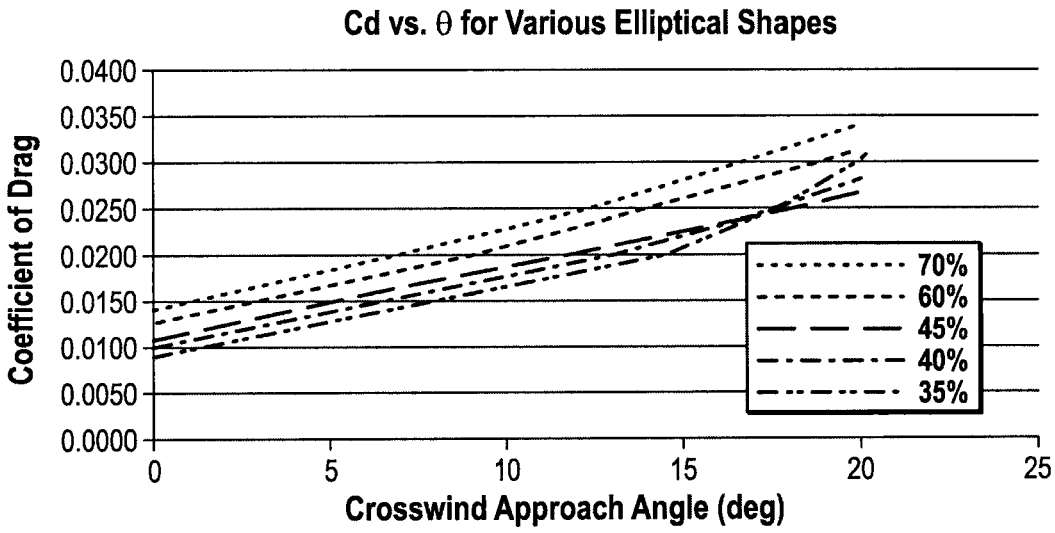
FIG. 29 is a graph showing coefficient of drag for stabilizers with different height-to-width ratio cross-sections.
Figure 30:
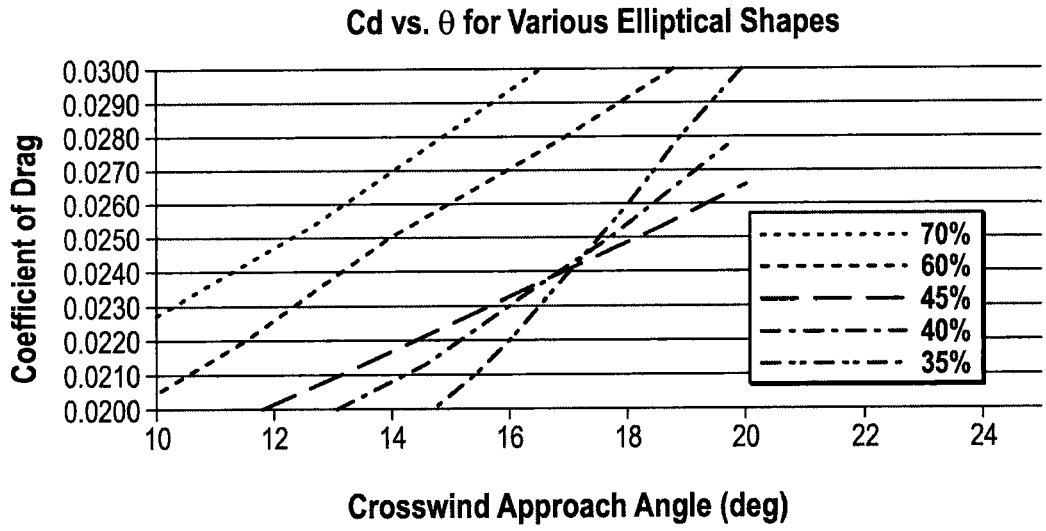
FIG. 30 is a graph showing a close-up view of a portion of the graph of FIG. 29.

FIGS. 29 and 30 are graphs showing coefficient of drag (Cd) values at various crosswind angles $\theta$ for oval or elliptical cross section shapes having a height-to-width ratio between 0.35 and 0.7. The graphs show that the ratio of about 0.4 has the lowest coefficient of drag value, particularly at higher angles of around 20°. Table 1 below shows the data that have been plotted in FIGS. 29 and 30. The Cd value for θ=20° is the lowest with height-to-width ratios in the range of 0.4 to 0.45. Table 1 also shows that the ratio of improvement over a 0.7 height-to-width ratio embodiment is maximized at higher angles θ (close to 20°) with height-to-width ratios of about 0.4 to 0.45.

The test data and analysis related to height-to-width ratios for a variety of headwind and crosswind angles γ, θ show optimum performance for height width ratios in the range of about 0.35 to about 0.60, more preferably about 0.38 to about 0.46, and most preferably about 0.419. Height-to-width ratios of about 0.63 and lower, and more preferably less than about 0.6 have improved coefficient of drag values as compared to height-to-width ratios of closer to 1.0 (e.g., in the range of about 0.63 to about 1.0, or about 0.69 to about 1.0).

Further testing and analysis have shown that in at least some cases with height-to-width ratios less than 0.35 that the coefficient of drag value decreases significantly for small crosswind angles in the range of about θ=0° to about θ=10°, but that there are diminishing returns for a reduction in coefficient of drag (Cd) for higher crosswind angles (e.g., θ=15° and greater angles).

Many different various features of the stabilizer disclosed herein (e.g., the shaft portion and dampener features) may each have the preferred height-to-width ratios disclosed herein. For example, the shaft portion 157 of the stabilizer 150 may have the same height-to-width ratio as the dampener 191 and distal weights 188. The shaft portion 257 of the stabilizer 250 may have the same height-to-width ratio as the dampener 291 and dampener mounts 299, 301. In other embodiments, some features of the stabilizer may have one height-to-width ratio and other features have a different height-to-width ratio. The height-to-width ratio may vary along a length of the dampener. For example, a height-to-width ratio may be greater (closer to 1.0) closer to the proximal end and lower (less than 1.0) towards the distal end. A change in height-to-width ratio may taper from one end to another end (e.g., taper from a larger height-to-width ratio at a proximal end to a smaller height-to-width ratio at the distal end). Typically, that portion of the stabilizer farthest from the archery bow is more influential in imposing undesired forces in the archery bow because of the greater moment arm length at those farthest spaced locations from the archery bow.

TABLE 1

| Height-to-width | Cd (θ = 0) | Cd (θ = 10) | Cd (θ = 15) | Cd (θ = 20) | Ratio of Improvement over 70% H:W θ = 0 | θ = 10 | θ = 15 | θ = 20 |
|---|---|---|---|---|---|---|---|---|
| 0.75 | 0.0146 | 0.0232 | 0.0289 | 0.0351 | −5% | −2% | −3% | −3% |
| 0.70 | 0.0139 | 0.0227 | 0.0281 | 0.034 | 0% | 0% | 0% | 0% |
| 0.65 | 0.0132 | 0.0213 | 0.0272 | 0.0326 | 5% | 6% | 3% | 4% |
| 0.60 | 0.0125 | 0.0205 | 0.0261 | 0.0312 | 10% | 10% | 7% | 8% |
| 0.50 | 0.0112 | 0.019 | 0.0236 | 0.0281 | 19% | 16% | 16% | 17% |
| 0.45 | 0.0106 | 0.0186 | 0.0224 | 0.0265 | 24% | 18% | 20% | 22% |
| 0.4 | 0.01 | 0.0174 | 0.0218 | 0.028 | 28% | 23% | 22% | 18% |
| 0.35 | 0.0088 | 0.0169 | 0.0204 | 0.0301 | 37% | 26% | 27% | 11% |

It should be noted that for purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The terms recited in the claims should be given their ordinary and customary meaning is determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. An archery bow stabilizer, comprising:

a stabilizer member having an elliptical shaped cross-section having a ratio of a minor axis dimension to a major axis dimension of about 0.6 or less to minimize a profile of the archery bow stabilizer exposed to crosswind forces;

an attachment member configured to connect the stabilizer member to an archery bow and including a threaded attachment portion extending from a proximal end of the archery bow stabilizer, the threaded attachment portion being operable to selectively adjust a final rotated position of the archery bow stabilizer relative to an archery bow.

2. The archery bow stabilizer of claim 1, wherein the stabilizer member includes an elongate body and at least one dampening member connected to an outer surface of the elongate body.

3. The archery bow stabilizer of claim 2, wherein the at least one dampening member comprises an elongate body arranged parallel with a length dimension of the archery bow stabilizer.

4. The archery bow stabilizer of claim 2, wherein the at least one dampening member is connected to and extends from a distal end of the elongate body.

5. The archery bow stabilizer of claim 2, wherein the at least one dampening member includes a plurality of dampening members arranged around a periphery of the elongate body.

6. The archery bow stabilizer of claim 5, wherein the plurality of dampening members are unequally spaced apart around the periphery of the elongate body.

7. The archery bow stabilizer of claim 1, wherein a size of the elliptical shaped cross-section changes along a length dimension of the archery bow stabilizer.

8. The archery bow stabilizer of claim 1, wherein the threaded attachment portion includes a first threaded portion configured to threadably connect to the archery bow stabilizer, and a second threaded portion configured to threadably connect to the archery bow, wherein the first threaded portion is more difficult to rotate relative to the archery bow stabilizer than rotation of the second threaded portion relative to the archery bow.

9. The archery bow stabilizer of claim 1, wherein the ratio of the minor axis dimension to the major axis dimension is in the range of about 0.35 to about 0.5.

10. The archery bow stabilizer of claim 9, wherein the ratio of the minor axis dimension to the major axis dimension is in the range of about 0.4 to about 0.45.

11. An archery bow comprising:

a riser;

limbs extending from the riser;

at least one cable member extending between the limbs;

a stabilizer extending from the riser, the stabilizer including a non-circular cross-sectional shape;

a stabilizer connector operable to adjust a final rotated position of the stabilizer to align a minor axis dimension of the non-circular cross-sectional shape with a length dimension of the riser.

12. The archery bow of claim 11, wherein the non-circular cross-sectional shape has a ratio of a maximum height dimension to a maximum width dimension that is in the range of about 0.1 to about 0.6.

13. The archery bow of claim 11, wherein the non-circular cross-sectional shape has a ratio of a maximum height dimension to a maximum width dimension that is in the range of about 0.35 to about 0.5.

14. The archery bow of claim 11, wherein the stabilizer connector includes a first threaded portion configured to threadably connect to the stabilizer, and a second threaded portion configured to threadably connect to the riser, the stabilizer connector providing a connection with the stabilizer that has a greater friction than a connection with the riser.

15. The archery bow of claim 11, wherein the stabilizer connector includes a first threaded portion configured to threadably connect to the stabilizer, and a second threaded portion configured to threadably connect to the riser, and the stabilizer includes a set screw configured to releasably secure the first threaded portion in a rotated position relative to the stabilizer.

16. The archery bow of claim 11, further comprising at least one dampener mounted to the stabilizer.

17. The archery bow of claim 16, wherein the at least one dampener includes a plurality of dampeners mounted around a perimeter of the stabilizer.

18. The archery bow of claim 17, wherein at least some of the plurality of dampeners are elongate and arranged in parallel with the length dimension of the stabilizer.

19. The archery bow of claim 11, wherein at least a portion of the stabilizer includes a plurality of dimples positioned on an exterior surface thereof.

20. A method of mounting a stabilizer to an archery bow, comprising:

providing an archery bow, a stabilizer, and a stabilizer connector threadably connected to the stabilizer, the stabilizer having a cross-sectional shape with a greater width dimension than a height dimension, the stabilizer being operable to stabilize the archery bow during use;

threadably mounting the stabilizer to the archery bow with the stabilizer connector by rotating the stabilizer into a stop position wherein no further rotation is possible;

checking whether the height dimension of the stabilizer is aligned with a length dimension of the archery bow;

if the height dimension of the stabilizer is not aligned with a length dimension of the archery bow when in the stop position, threadably dismounting the stabilizer from the archery bow, rotating the stabilizer connector relative to the stabilizer, and threadably mounting the stabilizer to the archery bow with the stabilizer connector by rotating the stabilizer into the stop position;

repeating the checking step, threadably dismounting step, rotating the stabilizer connector step, and threadably mounting the stabilizer step until the height dimension of the stabilizer is aligned with the length dimension of the archery bow.

21. The method of claim 20, wherein the stabilizer connector includes a first threaded portion configured to threadably connect with the stabilizer, and a second threaded portion configured to threadably connect with the archery bow, the first and second threaded portions having different friction properties.

22. The method of claim 20, wherein the stabilizer connector includes a tool interface at a proximal end thereof, and rotating the stabilizer includes coupling a tool to the tool interface and applying a rotation force to the stabilizer connector with the tool.

23. The method of claim 20, wherein the stabilizer has a ratio of height dimension to width dimension in the range of about 0.1 to about 0.5.

24. The method of claim 20, further comprising positioning a dampener on the stabilizer.

25. The method of claim 20, further comprising releasably fixing the stabilizer connector in a rotated position relative to the stabilizer.

26. An archery bow stabilizer, comprising:

a stabilizer member, comprising:

an elliptical shaped cross-section having a ratio of a minor axis dimension to a major axis dimension of about 0.6 or less to minimize a profile of the archery bow stabilizer exposed to crosswind forces;

an elongate body and at least one dampening member connected to an outer surface of the elongate body;

an attachment member configured to connect the stabilizer member to an archery bow.

27. The archery bow stabilizer of claim 26, wherein the at least one dampening member comprises an elongate body arranged parallel with a length dimension of the archery bow stabilizer.

28. The archery bow stabilizer of claim 26, wherein the at least one dampening member is connected to and extends from a distal end of the elongate body.

29. The archery bow stabilizer of claim 26, wherein the at least one dampening member includes a plurality of dampening members arranged around a periphery of the elongate body.

30. The archery bow stabilizer of claim 29, wherein the plurality of dampening members are unequally spaced apart around the periphery of the elongate body.

31. An archery bow stabilizer, comprising:

a stabilizer member having an elliptical shaped cross-section having a ratio of a minor axis dimension to a major axis dimension of about 0.6 or less to minimize a profile of the archery bow stabilizer exposed to crosswind forces;

an attachment member configured to connect the stabilizer member to an archery bow;

wherein a size of the elliptical shaped cross-section changes along a length dimension of the archery bow stabilizer.

32. The archery bow stabilizer of claim 31, wherein the stabilizer member includes an elongate body and at least one dampening member connected to an outer surface of the elongate body.

33. The archery bow stabilizer of claim 31, wherein the ratio of the minor axis dimension to the major axis dimension is in the range of about 0.35 to about 0.5.

* * * * *